US011398709B2

(12) United States Patent
Fröhlich et al.

(10) Patent No.: US 11,398,709 B2
(45) Date of Patent: Jul. 26, 2022

(54) CRIMPING MACHINE

(71) Applicant: Zoller & Fröhlich GmbH, WAngen im Allgäu (DE)

(72) Inventors: Christoph Fröhlich, Wangen (DE); Hans Leupolz, Argenbühl (DE)

(73) Assignee: ZOLLER & FRÖHLICH GMBH, Wangen im Allgäu (DE)

( * ) Notice: Subject to any disclaimer, the term of this patent is extended or adjusted under 35 U.S.C. 154(b) by 29 days.

(21) Appl. No.: 16/636,359

(22) PCT Filed: Aug. 7, 2018

(86) PCT No.: PCT/EP2018/071409

§ 371 (c)(1),
(2) Date: Feb. 4, 2020

(87) PCT Pub. No.: WO2019/034482

PCT Pub. Date: Feb. 21, 2019

(65) Prior Publication Data

US 2020/0169053 A1 May 28, 2020

(30) Foreign Application Priority Data

Aug. 18, 2017 (DE) ..... 10 2017 118 968.8

(51) Int. Cl.
*H01R 43/00* (2006.01)
*H01R 43/055* (2006.01)
*H01R 43/05* (2006.01)

(52) U.S. Cl.
CPC ..... *H01R 43/055* (2013.01); *H01R 43/05* (2013.01); *Y10T 29/53213* (2015.01)

(58) Field of Classification Search
CPC ..... Y10T 29/53235; Y10T 29/49185; Y10T 29/5142; Y10T 29/53213; Y10T 29/49181; Y10T 29/5149; Y10T 29/5193; Y10T 29/49147; Y10T 29/514; Y10T 29/49174; Y10T 29/49192; Y10T 29/53513; Y10T 29/53522; H01R 43/048; H01R 43/055; H01R 43/05; H01R 43/16; H02G 1/12; H02G 1/1202
USPC ..... 29/748.33 M, 564.4, 566.2, 753, 786, 29/809, 823, 861, 863, 867
See application file for complete search history.

(56) References Cited

U.S. PATENT DOCUMENTS 5,511,307 A 4/1996 Reiersgaard et al.
5,702,030 A 12/1997 Hulscher
(Continued)

FOREIGN PATENT DOCUMENTS

CN 1518175 A 8/2004
CN 104319595 A 1/2015
CN 204900570 U 12/2015
(Continued)

OTHER PUBLICATIONS

English translation of the Chinese Office Action dated Jan. 28, 2021 for Chinese patent application No. 201880053191.4.
(Continued)

*Primary Examiner* — Thiem D Phan
(74) *Attorney, Agent, or Firm* — Mindful IP PLLC

(57) ABSTRACT

Disclosed is a crimping machine for crimping contact elements comprising a conveying device via which a separated wire ferrule is guided from a transport unit towards a crimping head.

9 Claims, 7 Drawing Sheets

(56) References Cited

U.S. PATENT DOCUMENTS

| | | | | |
|---|---|---|---|---|
| 5,930,891 | A | 8/1999 | Loving, Sr. et al. | |
| 2016/0315438 | A1* | 10/2016 | Hattori | H01R 43/055 |

FOREIGN PATENT DOCUMENTS

| | | | |
|---|---|---|---|
| CN | 206259597 | U | 6/2017 |
| DE | 9308266 | U1 | 8/1993 |
| DE | 4238232 | A1 | 5/1994 |
| DE | 4306130 | A1 | 9/1994 |
| DE | 4440835 | C1 | 8/1996 |
| DE | 19714964 | C1 | 7/1998 |
| DE | 19831588 | A1 | 9/1999 |
| DE | 10 2004 057 818 | B3 | 8/2006 |
| DE | 102015102060 | A1 | 8/2016 |
| DE | 102015119217 | A1 | 5/2017 |
| EP | 1043814 | A2 | 10/2000 |
| EP | 1667289 | A1 | 6/2006 |
| JP | 1999-054236 | A | 2/1999 |
| JP | 2001052834 | A | 2/2001 |
| JP | 2005141909 | | 6/2005 |
| JP | 2008547167 | A | 12/2008 |
| JP | 2016517152 | A | 6/2016 |
| KR | 2016-0086379 | A | 7/2016 |

OTHER PUBLICATIONS

International Search Report and Written Opinion for PCT/EP2018/071409 dated Oct. 25, 2018 (14 pages; with English translation).

International Preliminary Report on Patentability for PCT/EP2018/071409 dated Oct. 25, 2018 (7 pages).

Communication from EPO under Rule 71(3) EPC with English Translation.

Certified Notice of Allowance From The Japanese Patent Office for Parallel Patent Application 2020-530722 dated Jul. 6, 2021 With English Translation.

Office Action Summary dated Aug. 23, 2021 re Korean Application No. 10-2020-7007256 (1 page).

Korean 1st Office Action dated Aug. 23, 2021 re Korean Application No. 10-2020-7007256 with English translation (9 page).

* cited by examiner

CRIMPING MACHINE

CROSS-REFERENCE TO RELATED APPLICATIONS

This application is a national stage of, and claims priority to, Patent Cooperation Treaty Application No. PCT/EP2018/071409, filed on Aug. 7, 2018, which application claims priority to German Application No. DE 10 2017 118 968.8, filed on Aug. 18, 2017, which applications are hereby incorporated herein by reference in their entireties.

DESCRIPTION

The disclosure relates to a crimping machine as disclosed herein.

Such a crimping machine is known, for example, from the patent specification DE 44 40 835 C1 to the applicant and serves for crimping wire ferrules with a stripped cable end, for example. The wire ferrules are wound, in the known solution, as a webbing onto a drum magazine and are conveyed from there via a transport unit toward a crimping head. As an alternative, the wire ferrules or contact elements may also be received singled in a storage and may then be conveyed, in a defined position, to the crimping head via an appropriate feeding device. Such feeding device is described, for example, in DE 198 31 588 A1.

In the known solutions, the wire ferrule to be crimped is put onto the stripped cable end by means of a holding unit and is then crimped via the crimping head. The stripping of the cable end can be either external or via a stripping head integrated in the crimping machine.

The design of a transport unit for conveying the wire ferrules arranged on a webbing or any other electric components is described, for example, in the applicant's document G 93 08 266.5. A similar transport unit is also disclosed in DE197 14 964 C1.

In series production it is necessary to crimp different cable cross-sections and electric components/contact elements to one another and then to install them in a subsequent mounting step, for example when mounting a switch cabinet. For this, there are basically two options: In one variant, the crimping machine is retooled for crimping different cable cross-sections and/or contact elements (wire ferrules), or else plural crimping machines are provided for processing the different cable cross-sections/contact elements. The former solution requires long setup times and considerable personnel costs. This drawback is overcome in the latter solution by a plurality of crimping machines—however, the investment costs are considerable.

In the document DE 10 2004 057 818 B3, a machine (in the form of a stripper, crimper) is disclosed by which different cable cross-sections and wire ferrules can be processed. Accordingly, for each wire ferrule type a drum magazine and a related crimping unit are provided to which a joint drive is assigned which can optionally be operatively engaged in one of the crimping units. Such solution requires high apparatus effort, as a plurality of crimping units has to be provided and controlled.

DE 10 2015 119 217 A1 to the applicant illustrates a crimping machine by which the afore-mentioned drawbacks are eliminated. The crimping machine has a storage arrangement including plural drum magazines to which a joint transport unit and a joint crimping head are assigned so that the apparatus effort is significantly reduced as compared to the afore-described solution.

DE 10 2015 102 060 A1 also to the applicant illustrates a crimping machine in which different wire ferrules are provided in a storage arrangement including plural drum magazines. A transport unit via which the respective pre-selected wire ferrule is transported into a transfer position is assigned to each of the drum magazines. The wire ferrule is separated there and then guided to a joint crimping head by means of a shuttle.

This crimping machine excels by high productivity. However, a certain drawback is perceived in the fact that the shuttle required has a comparatively complex design and requires corresponding space and no stripping is possible.

As compared to this, the object underlying the disclosure is to provide a machine suited for stripping and crimping by which flexible manufacture is possible with a comparatively simple design.

This object is achieved by a crimping machine comprising features as disclosed herein.

The disclosed crimping machine serves for crimping contact elements with an end section of a conductor, for example a cable end. The crimping machine has a storage arrangement including plural magazines, wherein a transport unit for transporting the contact element, for instance a wire ferrule, to a cutting device is assigned to each magazine. The crimping machine moreover includes a centering device for positioning the conductor end section with respect to a crimping head via which the contact element is crimped with the end section of the conductor (cable end). In accordance with the disclosure, a guiding device via which the separated contact element is guided toward the crimping head is arranged between the crimping head and the cutting device. The guiding device has a plurality of inputs each of which is assigned to a transport unit and, respectively, a contact element cross-section. The inputs open into an output on the crimping head side via channels along which the contact element to be crimped is guided. At the output, the contact element is taken over and inserted into the crimping head.

The contact element to be crimped is thus directly guided into the operating area of the crimping head without interconnecting a complex shuttle or the like. The guiding is realized with minimum apparatus effort by the described guiding device, which works substantially without any movable components and conveys the contact element by the effect of gravity, only supported by applying compressed air or the like, if at all.

In an example, the guiding device is funnel-shaped, with the inputs being configured to be located next to each other on the one side. From the inputs, the channels then extend to converge to the opposite joint output.

As already mentioned in the foregoing, the channels are orientated in the crimping machine preferably in the direction of gravity, i.e. in the vertical direction, so that the transport of the contact elements within the guiding device is at least supported by gravity.

In one example, the transport can be accelerated when a suitable accelerating device is provided via which the movement of the contact element within the guiding device is supported. Such accelerating device may include, for example, a compressed air channel, via which a compressed air jet is directed to the contact element. Accordingly, a compressed air channel can be assigned to each channel or a joint compressed air channel can be assigned to all channels.

The operating safety can be further improved when in the area of the output of the guiding device a sensor detecting the approach of a contact element is disposed. Then the crimping head and the related functional elements are controlled by means of a control unit via the then generated sensor signal.

In another example, a stripper is further integrated in the crimping machine.

The crimping machine may be provided with a control panel/display via which the cable cross-section/contact element type is selected. In response to such entry, the transport unit and the cutting device, the stripping unit and the crimping head as well as other functional elements are controlled via the control unit.

The crimping machine is preferably pneumatically operated. Basically, also a motor-driven operation can be realized, however.

The actual structure of the transport unit, the stripping unit and the crimping head is known from the state of the art to the applicant, especially DE 44 40 835 C1 and DE 10 2015 102 060 A1 as well as the state of the art cited there, so that in the following a detailed description of these units known per se will be renounced and in this respect the disclosure of the mentioned documents which belong to the disclosure of the present application will be referred to.

BRIEF DESCRIPTION OF DRAWINGS

Examples are illustrated in detail in the following by way of schematic drawings, wherein.

DETAILED DESCRIPTION

Figure 1:
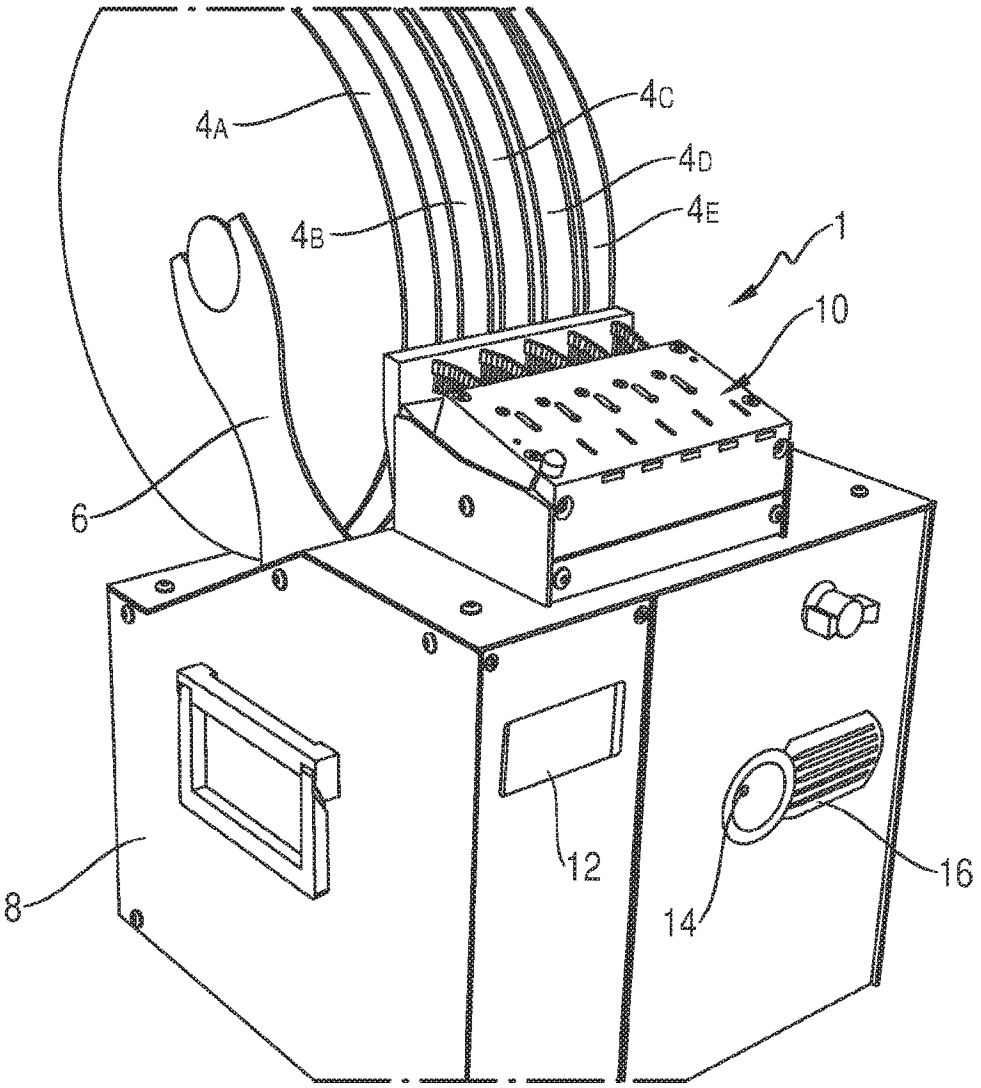
FIG. 1 shows a three-dimensional view of a crimping machine according to the disclosure.

FIG. 1 illustrates a three-dimensional view of a crimping machine 1 by which five different wire ferrules or other contact elements and corresponding cable cross-sections can be processed. Each of the wire ferrules 2 is provided as a webbing. In the shown example, the webbings are wound onto five drum magazines 4*a*, 4*b*, 4*c*, 4*d* and 4*e* which are rotatably supported on a housing 8 of the crimping machine 1 via a magazine holder 6. Each webbing including the wire ferrules 2 then is wound off the drum magazine 4 via a respective transport unit, wherein the transport units are combined into a transport module 10 mounted on the housing 8.

At the housing front, visible in FIG. 1, there is arranged a display 12, for example in the form of a touch display, so that appropriate entries for selecting the cable cross-section or the like can be made.

Approximately in the middle of the shown front side, a centering and guiding device 14 is provided which bulges inwardly in about funnel shape and via which the cable ends 16 to be processed can be supplied. As stated in the foregoing, five different cable cross-sections can be processed by the shown crimping machine 1. As a matter of course, the crimping machine 1 can also be designed for processing more or fewer cable cross-sections and a corresponding number of wire ferrules.

Figure 2:
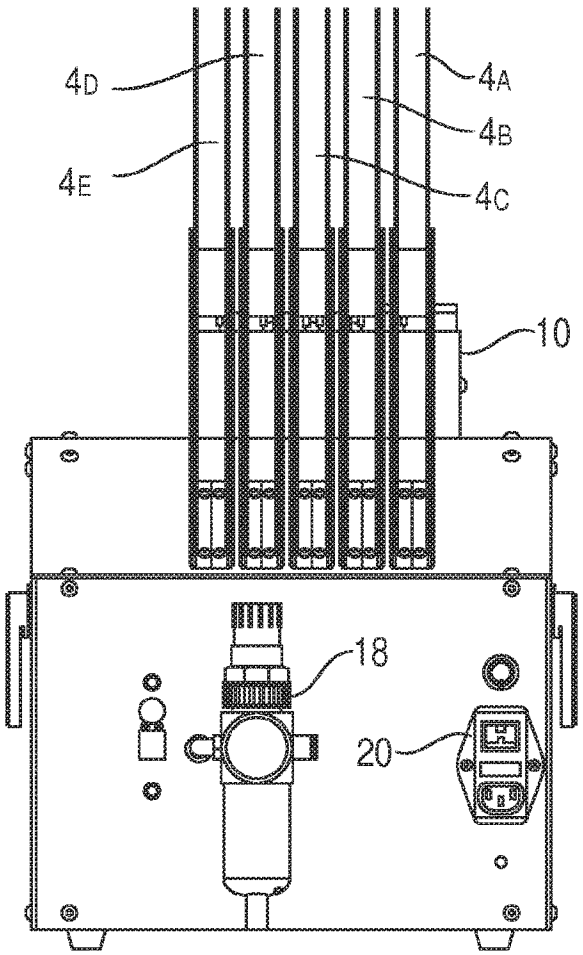
FIG. 2 shows a rear view of the crimping machine from FIG. 1.

FIG. 2 illustrates a rear view of the crimping machine 1 according to FIG. 1. This representation shows the five drum magazines 4*a*, 4*b*, 4*c*, 4*d*, 4*e*, wherein the webbings are not shown. The latter then run from the drum magazines 4*a*, 4*b*, 4*c*, 4*d* and 4*e* into the transport module 10 which is mounted on the housing 8. The described crimping machine 1 is operated by compressed air. An appropriate compressed air supply 18 is arranged on the rear side shown in FIG. 2. On the rear side of the housing 8, an electrical connection 20 having an ON/OFF switch as well as further sockets/terminals for signal transmission and, respectively, energy supply are additionally provided.

Figure 3:
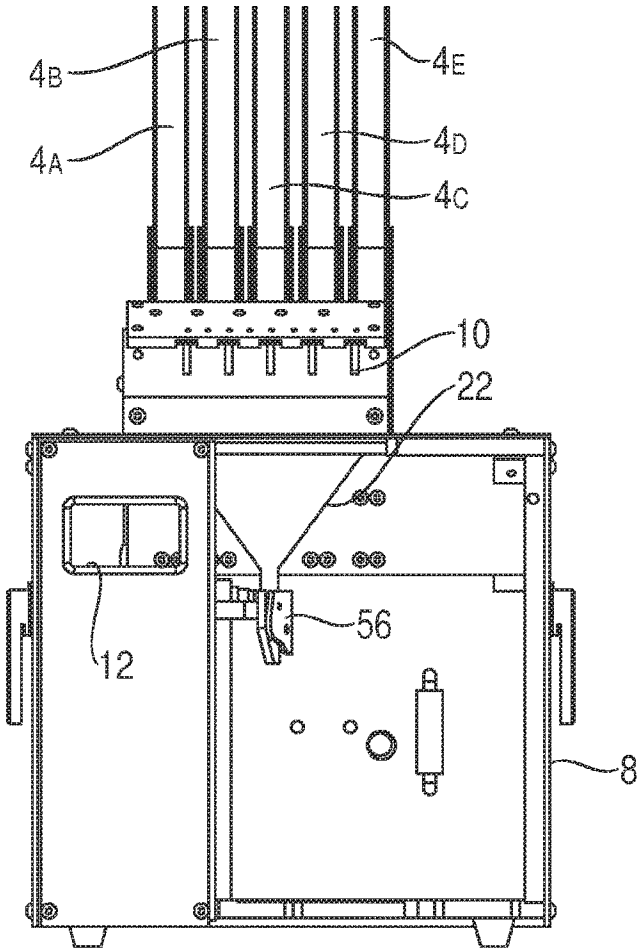
FIG. 3 shows a front view of the crimping machine with a partly opened housing and merely a partial representation of the functional units.

FIG. 3 illustrates the crimping machine according to FIGS. 1 and 2 when the housing 8 is partly opened, wherein this representation shows merely in the housing interior a guiding device 22 via which a wire ferrule to be processed is guided toward a crimping head not shown and a stripper unit as well as the related functional elements, for example sleeve holding pliers and conductor holding pliers not shown to simplify matters. The basic structure of these elements is known—as explained in the beginning—from the cited state of the art.

Figure 4:
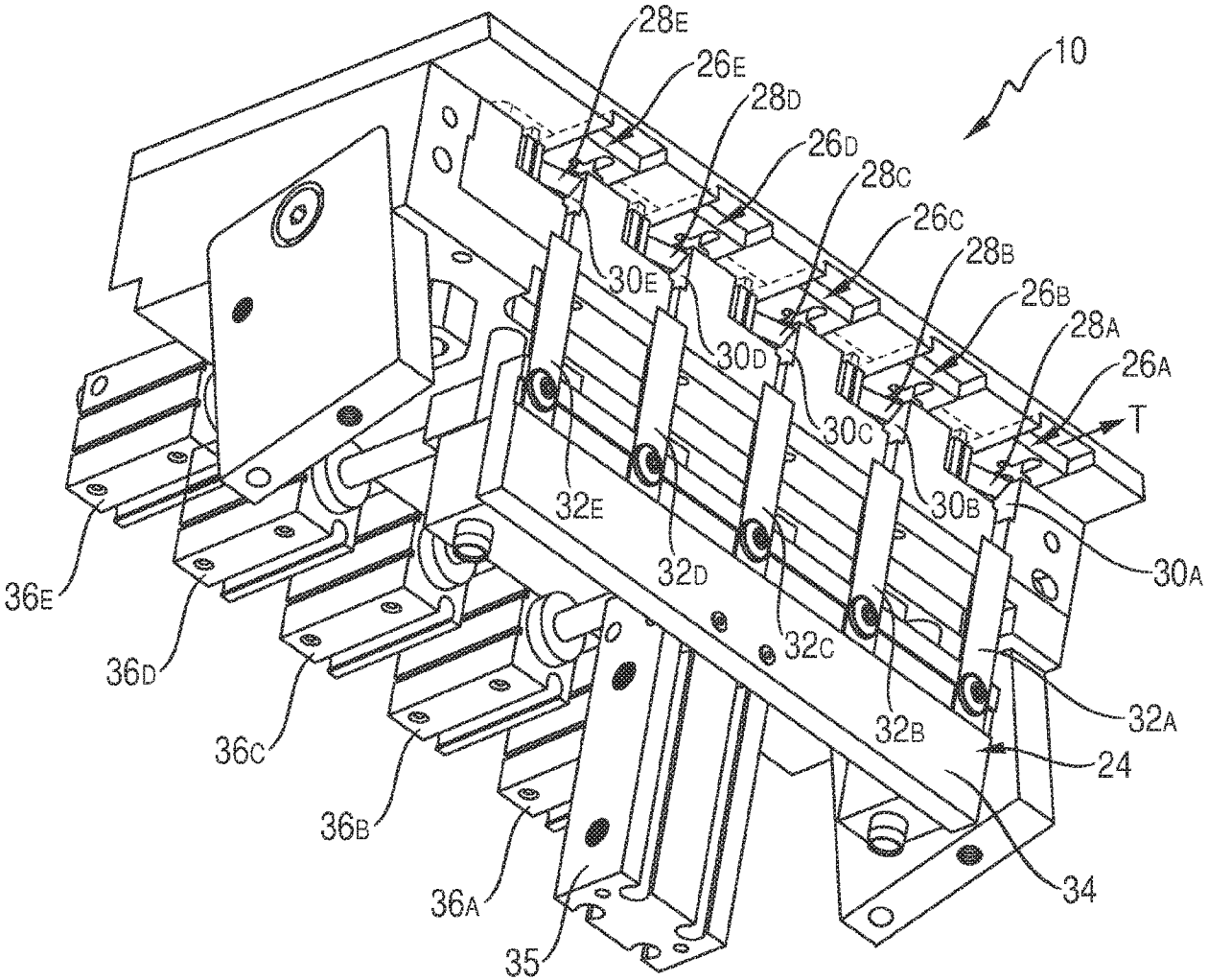
FIG. 4 shows an individual representation of a transport unit and a cutting device of the crimping machine according to FIGS. 1 to 3.

FIG. 4 shows an individual representation of the transport module 19 which is provided, in the representations according to FIGS. 1 to 3, with an enclosure—the enclosure is omitted in the representation according to FIG. 4. A cutting device 24 via which a wire ferrule 2 to be processed can be separated from the respective webbing is assigned to the transport module 10. As previously described, the transport module 10 includes five transport units 26*a*, 26*b*, 26*c*, 26*d*, 26*e* whose basic structure is known per se. In this respect, the patent DE 44 40 835 C1 to applicant (FIGS. 10a, 10b) is referred to. Such transport unit 26 consequently has a pneumatically actuated transport pawl 28*a*, 28*b*, 28*c*, 28*d* and 28*e* biased into a home position which engages, by a transport projection, in the area between two wire ferrules 2 adjacent on the webbing and, by appropriate control, displaces the wire ferrules in the transport direction (see arrow T), wherein each stroke corresponds to the diameter of a wire ferrule. During the transport, the respective webbing is guided in a guiding groove whose geometry is adapted to that of the webbing. The transport pawl 28 acts upon the respective plastic sleeves of the wire ferrules. In the representation according to FIG. 4, the opening areas of the afore-mentioned guides 30*a*, 30*b*, 30*c*, 30*d* and 30*e* are shown, wherein the plastic collars of the wire ferrules are guided in the pawl-side area of the guides 30*a*, 30*b*, 30*c*, 30*d* and 30*e* at the top in FIG. 4 and, correspondingly, the actual metal sleeves of the wire ferrules are guided in the constricted area. Corresponding to the cable cross-sections to be processed, also the inside diameter of each of the respective guides 30*a*, 30*b*, 30*c*, 30*d* and 30*e* is designed to be different. In the representation according to FIG. 4, the size of the wire ferrules to be processed is reduced from the right to the left.

The transport units 26*a*, 26*b*, 26*c*, 26*d* and 26*e* can be individually controlled so that, in accordance with the preselected cable cross-section, only the related transport unit 26 is actuated.

The wire ferrule 2 displaced into the opening area shown in FIG. 4 due to a stroke of the transport unit 26 then is separated from the webbing by means of the cutting device 24. In the shown example, the cutting device 24 is configured to have five sleeve separating blades 32*a*, 32*b*, 32*c*, 32*d*, 32*e* which are fastened to a joint cutting bar 34 which can be operated by means of a pneumatic cylinder 35. The pneumatic cylinder 35 extends for separating the wire ferrule 2 so that the cutting bar 34 including the sleeve separating blades 32 moves upwards in the representation according to FIG. 4 and separates the front wire ferrule. In so doing, all of the five sleeve separating blades 32 are simultaneously operated—but as just one wire ferrule is located in the operating area, the other four sleeve separating blades so-to-speak perform an idle stroke without any cutting engagement.

The representation according to FIG. 4 further shows by the reference numerals 36*a*, 36*b*, 36*c*, 36*d* and 36*e* pneumatic cylinders for operating the transport unit 26, more exactly speaking the transport pawls 28. The pneumatic cylinders 36 are double-acting cylinders that are controlled via a related pneumatic valve.

Figure 5:
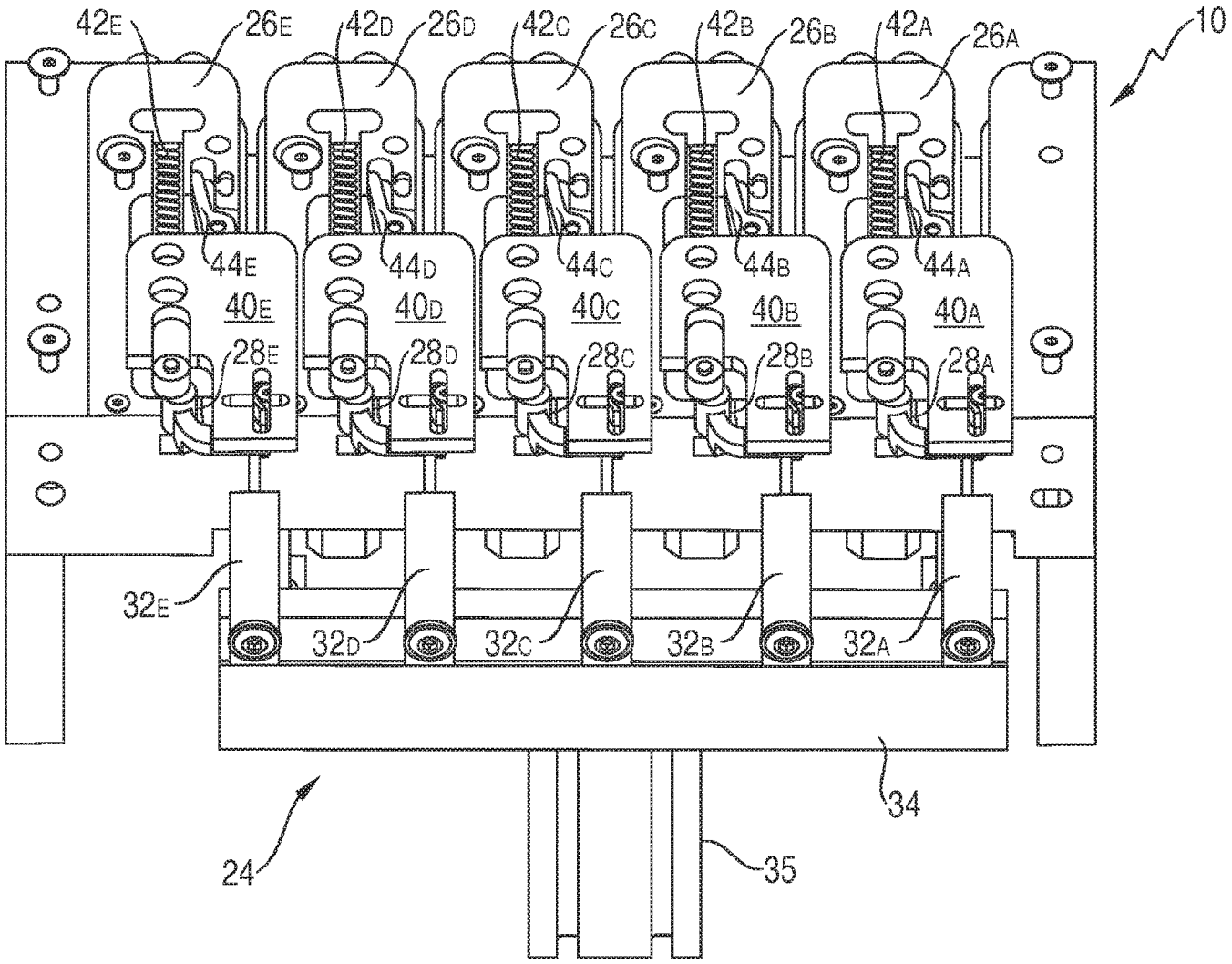
FIG. 5 shows a view of the unit according to FIG. 4 when viewed from above.

FIG. 5 illustrates a top view onto the transport module 10, wherein a cover 38 indicated in FIG. 4 is not shown. In this view, five guiding plates 40*a*, 40*b*, 40*c*, 40*d* and 40*e* of the transport units 26 with the associated transport pawls 28*a*, 28*b*, 28*c*, 28*d* and 28*e* and the related bearing as well as including tension springs 42*a*, 42*b*, 42*c*, 42*d* and 42*e* via which the transport pawls 28*a*, 28*b*, 28*c*, 28*d* and 28*e* are biased to their engaging position are visible. Also visible in this representation are pivot-mounted pawls 44*a*, 44*b*, 44*c*, 44*d* and 44*e* which are operatively engaged in the respective webbing during transport so as to hold or guide the webbing in the predetermined transport position.

At the bottom of FIG. 5, the cutting device 24 including the pneumatic cylinder 35 as well as the cutting bar 34 and the sleeve separating blades 32*a*, 32*b*, 32*c*, 32*d* and 32*e* is evident. The wire ferrule 2 separated by operation of the cutting device 34 then falls downwards in the direction of gravity into the guiding device 22 already shown in FIG. 3. The guiding device 22 is orientated in the direction of gravity so that the separated wire ferrule 2 is conveyed by gravity.

Figure 6:
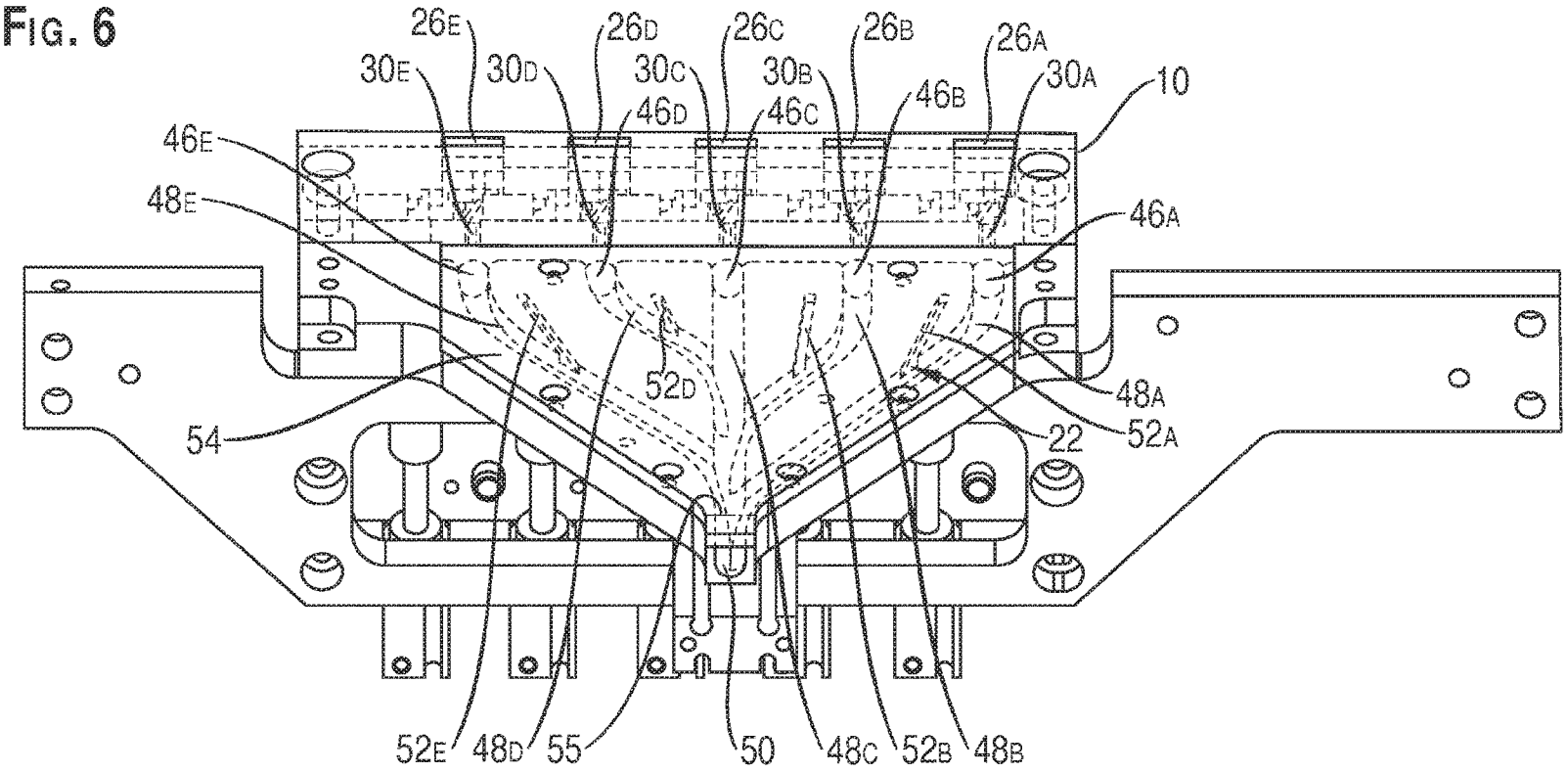
FIG. 6 shows a three-dimensional representation of the transport unit comprising a guiding device according to the disclosure.

In the representation according to FIG. 6, the guiding device 22 has an approximately funnel-shaped structure tapering away from the transport module 10. Each of the guides 30*a*, 30*b*, 30*c*, 30*d* and 30*e* shown in FIG. 4 opens into an input 46*a*, 46*b*, 46*c*, 46*d* and 46*e* whose cross-section is selected such that the wire ferrules 2 may enter into the guiding device 22 with minimum friction. Each of the inputs 46 then opens into a respective channel 48*a*, 48*b*, 48*c*, 48*d* and 48*e*, which channels are downwardly convergent and merge in an output 50. The central channel 48*c* extends in the direction of gravity directly from the related input 46*c* to the output 50. The two adjacent channels 48*b* and 48*d* in the central area converge into the channel 48*c*. The two outer channels 48*a* and 48*e* open, in the area of the output 50, into the central channel 48*c*. In other words, the channels 48 are meandering, when viewed from the output 50, toward the inputs 46, with the geometry being optimized with regard to the minimum friction during transport/falling of the wire ferrules 2.

For supporting the transport movement, a compressed air channel 52*a*, 52*b*, 52*d*, 52*c* opens into each of the curved outer channels 48*a*, 48*b*, 48*d*, 48*e*, via which compressed air channels a compressed air jet can be introduced, upon controlling a respective compressed air valve, for supporting the transport movement, with the control being carried out, as a matter of course, such that the wire ferrules are accelerated in the transport direction. For the central channel 48*c* this is not necessary as this channel has no deflection. In the end area of the funnel-shaped guiding device 22 a light barrier 55 indicated in FIG. 6 is located for monitoring the falling of the wire ferrule 2 and transmitting a corresponding control signal to the control unit.

Figure 7:
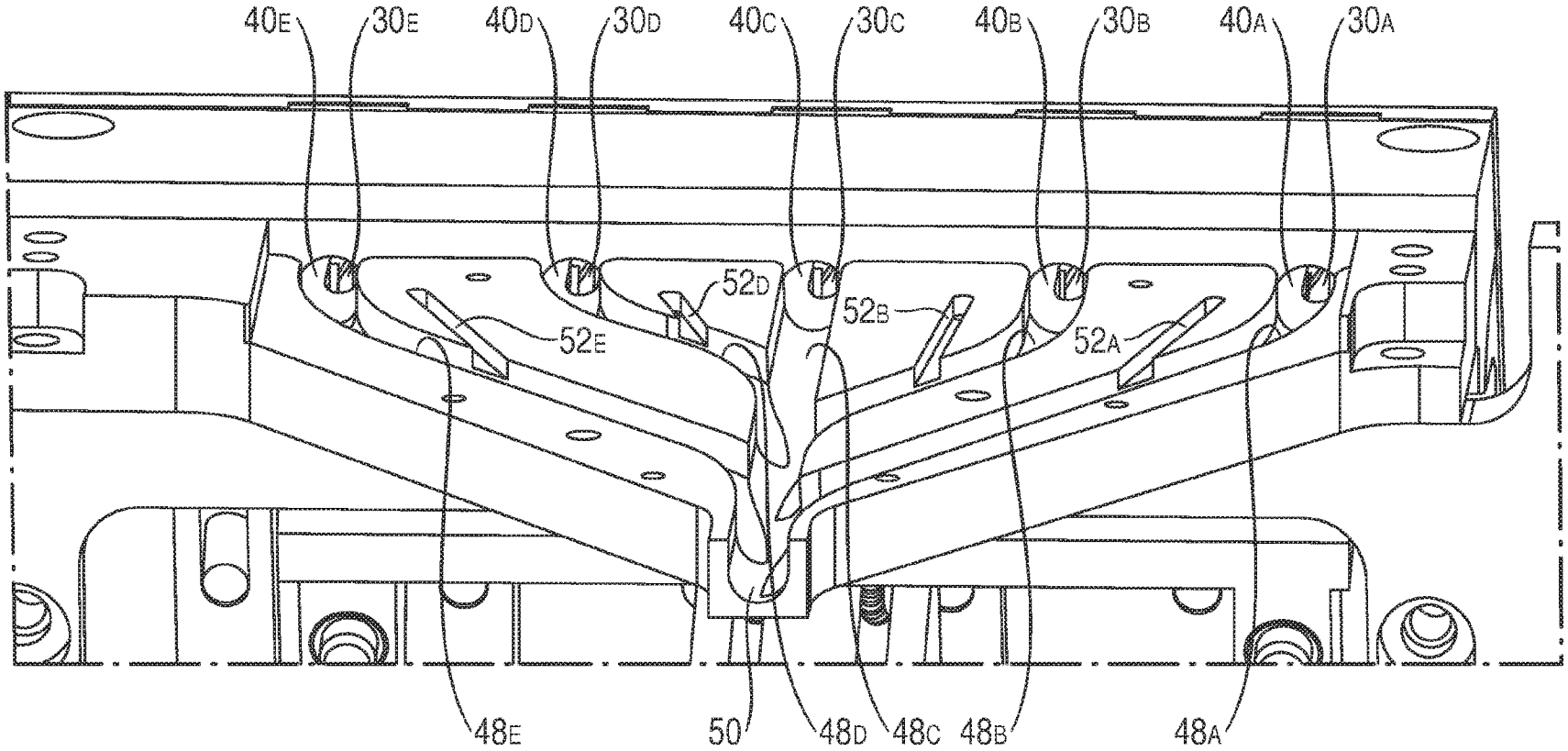
FIG. 7 shows the guiding device from FIG. 6 when viewed from below.

FIG. 7 illustrates the guiding device 22 including the afore-mentioned inputs 46*a*, 46*b*, 46*c*, 46*d* and 46*e*, the joint output 50 and the related channels 48*a*, 48*b*, 48*c*, 48*d* and 48*e* in a different view, wherein a cover plate 54 transparently shown in FIG. 6 is not shown. In the representation according to FIG. 7, the opening areas of the outer channels 48*a*, 48*b*, 48*d* and 48*e* into the central channel 48*c* orientated in the direction of gravity and the opening areas of the compressed air channels 52*a*, 52*b*, 52*d*, 52*e* into the respective assigned channels are clearly evident.

Figure 8:
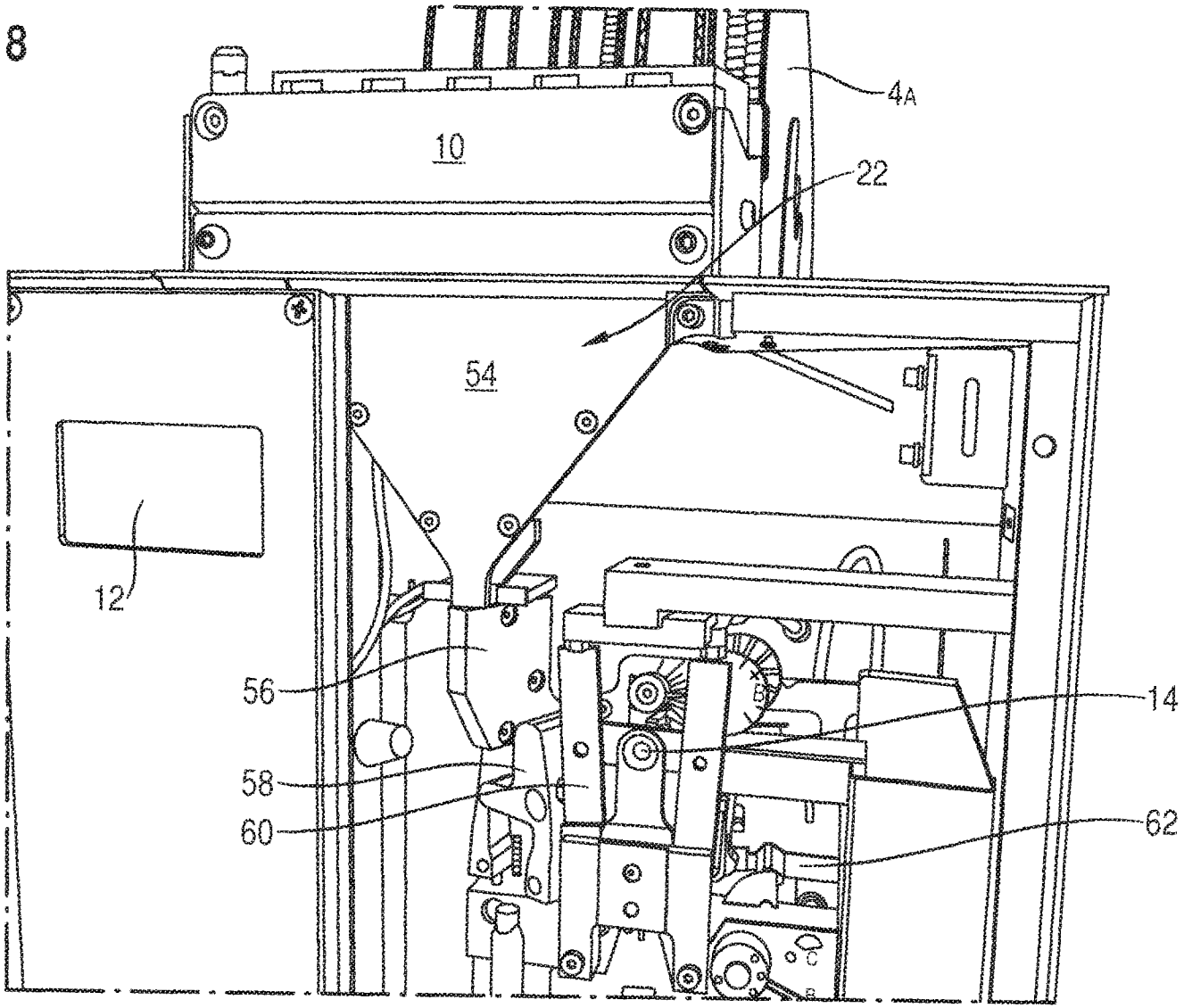
FIG. 8 shows a representation of the crimping machine with the housing being opened.

FIG. 8 illustrates a partial view of the crimping machine 1 with the housing 8 being opened so that some of the described functional elements are visible. Evident at the top is the transport module 10 including the integrated cutting device 34. The funnel-shaped guiding device 22 orientated in the direction of gravity which in this view is covered by the cover plate 54 is connected to the transport module 10.

The output 50 of the guiding device 22 opens into a guiding plate 56 also indicated in FIG. 3. Along this guiding plate 56, supported by the compressed air jet, the separated singled wire ferrule 2 is guided toward sleeve holding pliers 58 which in turn are supported on a swivel plate. The sleeve holding pliers 58 take over the isolated wire ferrule 2.

In parallel to the singling and to the transport of the wire ferrule 2 toward the input 46, the insulation of the cable end is cut in via a stripping unit 60 guided on an adjustable tool carriage 62.

After a fallen wire ferrule 2 has been reported via the light barrier 55, the tool carriage 62 is moved backward. By this movement the insulation is removed from the cable end. A swivel plate pivot-mounted on the tool carriage 62 moves the sleeve holding pliers 58 and thus the separated wire ferrule 2 into a position in which the cable end and the wire ferrule 2 are arranged coaxially to each other. In a following step, the tool carriage 62 moves forward so that the wire ferrule is pushed onto the stripped cable end held by conductor holding pliers. In a subsequent working cycle, the wire ferrule is crimped to the cable end via a crimping head and the conductor holding pliers are opened so that the wire ferrule and the cable end crimped thereto can be removed.

If a different cross-section is to be processed, a corresponding entry is made on the touch display 12. Then the same afore-described working cycle is run, wherein, depending on the entry, a different transport unit 26 is driven via the corresponding pneumatic valve and the assigned pneumatic cylinder.

In the shown example, the crimping machine 1 is designed for processing wire ferrules for wire cross-sections of 0.5 $mm^2$, 0.75 $mm^2$, 1.0 $mm^2$, 1.5 $mm^2$ and 2.5 $mm^2$; as a matter of course, the machine can also be designed for processing other cross-sections.

Disclosed is, a crimping machine comprising a conveying device via which a separated wire ferrule is guided from a transport unit toward a crimping head.

LIST OF REFERENCE NUMERALS

1 crimping machine
2 wire ferrule
4 drum magazine
6 magazine holder

8 housing
10 transport module
12 display
14 centering/feeding device
16 cable end
18 compressed air supply
20 electrical connection
22 guiding device
24 cutting device
26 transport unit
28 transport pawl
30 guide
32 sleeve separating blade
34 cutting bar
35 pneumatic cylinder
36 cylinder
38 cover
40 guiding plate
42 tension spring
44 pawl
46 input
48 channel
50 output
52 compressed air channel
54 cover plate
55 light barrier
56 guiding plate
58 sleeve holding pliers
60 stripping unit
62 tool carriage

The invention claimed is:

1. A crimping machine for crimping contact elements, each contact element comprising an end section of a conductor such as a cable end, the crimping machine comprising a storage arrangement having a plurality of magazines, wherein a transport unit for transporting the contact elements to a cutting device is assigned respectively to each magazine, the crimping machine further comprising a centering device for positioning the conductor with respect to a crimping head for crimping the contact elements to the conductor, wherein the crimping machine further includes a guiding device in an area between the cutting device and the crimping head, and further wherein one input of the guiding device is assigned respectively to each transport unit and all of the inputs open, via channels, into a joint output on a crimping head side of the guiding device via which output a separated contact element from the contact elements is conveyed to the crimping head, wherein the channels extend substantially in a direction of gravity.

2. The crimping machine according to claim 1, wherein the contact elements are wire ferrules.

3. The crimping machine according to claim 1, wherein the guiding device is funnel-shaped with the inputs located next to each other on a side of the guiding device from which the channels arranged to be convergent lead to the output.

4. The crimping machine according to claim 1, further comprising an accelerating device via which a movement of the separated contact element within the guiding device is supported.

5. The crimping machine according to claim 4, wherein the accelerating device includes compressed air channels via which a compressed air jet is directed to the separated contact element which is to be conveyed inside the channels.

6. The crimping machine according to claim 1, further comprising a sensor for detecting an approach of the separated contact element to the output.

7. The crimping machine according to claim 1, further comprising a stripping unit for the conductor, conductor holding pliers, sleeve holding pliers, a tool carriage and a swivel plate which is supported on the tool carriage and via which the sleeve holding pliers are movable from a transfer position at the guiding device to a crimping position.

8. The crimping machine according to claim 1, comprising a control panel for selecting a contact element type and a control unit for controlling functional elements in response to an entry to the control panel.

9. The crimping machine according to claim 8, wherein the functional elements include the transport units, and the cutting device.

* * * * *